United States Patent [19]

Tate

[11] Patent Number: 4,613,280

[45] Date of Patent: Sep. 23, 1986

[54] PASSIVELY MODULATED COOLING OF TURBINE SHROUD

[75] Inventor: Michael J. Tate, Stratford, Conn.

[73] Assignee: Avco Corporation, Stratford, Conn.

[21] Appl. No.: 653,036

[22] Filed: Sep. 21, 1984

[51] Int. Cl.[4] ..... F01D 25/12; F01D 21/00

[52] U.S. Cl. ..... 415/17; 415/110; 415/115; 415/126; 415/176

[58] Field of Search ..... 415/110, 113, 115–117, 415/134–139, 175, 176, 178, 180, 126–128, 177, 17, 47; 60/39.75

[56] References Cited

U.S. PATENT DOCUMENTS

| | | | |
|---|---|---|---|
| 3,295,824 | 1/1967 | Woodwell et al. | 415/178 |
| 3,575,528 | 4/1971 | Beam, Jr. et al. | 415/115 X |
| 3,584,458 | 6/1971 | Wetzler | 60/39.75 |
| 3,736,069 | 5/1973 | Beam, Jr. et al. | 415/115 |
| 3,814,313 | 6/1974 | Beam, Jr. et al. | 415/116 |
| 3,966,354 | 6/1976 | Patterson | 415/116 |
| 4,005,946 | 2/1977 | Brown et al. | 415/178 |
| 4,217,755 | 8/1980 | Williams | 415/115 X |
| 4,307,993 | 12/1981 | Hartel | 415/116 |

*Primary Examiner*—Robert E. Garrett
*Assistant Examiner*—H. Edward
*Attorney, Agent, or Firm*—Ralph D. Gelling

[57] ABSTRACT

A turbine engine is constructed to passively modulate the flow of cooling air into the shroud. Sealing rings are disposed relative to the cooling air inlets in the shroud such that pressure and temperature variations in the engine will cause the cooling air inlets to be either fully opened, completely blocked by the sealing ring, or modulating therebetween in accordance with the cooling needs of the shroud.

6 Claims, 8 Drawing Figures

PASSIVELY MODULATED COOLING OF TURBINE SHROUD

BACKGROUND OF THE INVENTION

The efficiency of a turbine engine is enhanced by maximizing the proportion of gas that is properly directed into the rotating vanes or stationary impellers disposed throughout the engine. More particularly, air that flows through the arrays of rotating end stationary vanes contributes to the work performed by the engine, whereas air that escapes around the tips of the vanes performs no work and is lost.

The arrays of rotating turbine blades in the turbine engine are surrounded by a stationary shroud. The proportion of the gases that perform useful work in passing through the arrays of turbine blades can be increased by minimizing the clearance between the tips of the rotating turbine blades and the inner cylindrical surface of the stationary shroud.

Both the rotating turbine assembly and the cylindrical shroud surrounding it expand radially outwardly when subjected to increases in temperature and contract radially inwardly when the temperature decreases. However, the rotating turbine assembly generally is a massive structure, while the stationary shroud which surrounds the turbine typically is of comparatively low mass. As a result of these substantial physical differences, the turbine assembly and the shroud react quite differently to variations in temperature. More particularly, the shroud will expand radially outwardly much more quickly than the turbine assembly when subjected to an increase in temperature, and conversely the shroud will contract radially inwardly much more quickly than the turbine when temperatures decrease. Consequently, there is a tendency for a large tip clearance to be created for a period of time following an increase in temperature, such as the temperature increase that may occur during an acceleration of the engine. On the other hand, there is a tendency for the shroud to rub against the turbine during a period following a decrease in temperature, such as the decrease which occurs in conjunction with a deceleration.

The shroud often is cooled to reduce its rate of thermal expansion and to control the total growth achieved during steady state operation, thereby minimizing running tip clearance. This cooling typically is accomplished by removing air from the compressor and directing that air into channels formed in the shroud. Since the air extracted from the compressor has not yet passed through the combustor, it is significantly cooler than the combustion gases which approach the turbine assembly and the shroud. Therefore, the rate of thermal expansion of the shroud is reduced with a resulting decrease in tip clearance during conditions of temperature increase in the turbine engine.

Although the cooling of the shroud has a desirable effect during the transient conditions where expansion is likely, cooling has a negative effect when transient operating conditions cause the shroud to contract. For example, when the engine is undergoing a deceleration the shroud rapidly contracts radially inwardly. The cooling gases directed into the shroud can only accelerate this already rapid inward contraction. Therefore, to prevent rubbing during periods of deceleration it often has been necessary to build a greater cold tip clearance into the engine then would otherwise be desirable.

A secondary problem associated with cooling the shroud during periods of deceleration and low power operation is that the cooler air is being extracted from the combustor even though it is not required in the shroud. The extraction of this air from the combustor carries a price in terms of efficiency, in that work has been performed to compress this air, but the air is then being extracted to perform an unneeded cooling function rather than being directed to the combustor where it can continue to perform useful work.

Attempts have been made to control the amount of cooling air that is directed to the shroud. To the extent these attempts could be successful they could enable a smaller cold tip clearance with a resultant increase in efficiency during all operating conditions. Additionally to the extent these attempts could be successful, there could be a reduction in the amount of cooling air extracted from the compressor, thereby enabling this compressed air to be put to more useful purposes. However, the prior attempts to control shroud cooling have been extremely costly, inefficient and cumbersome.

In view of the above, it is an object of the subject invention to provide an efficient shroud construction to modulate the flow of cooling air to the shroud.

It is another object of the subject invention to provide a turbine engine construction in which cooling air to the turbine shroud is passively modulated.

It is an additional object of the subject invention to provide a passively modulated turbine shroud which is properly cooled without additional external equipment for controlling the flow of cooling air thereto.

It is still another object of the subject invention to provide a turbine shroud which can enable a smaller tip clearance under all operating conditions.

It is still an additional object of the subject invention to provide a turbine shroud which will undergo thermal expansion and contraction which closely approximates the expansion and contraction of the rotating turbine assembly.

SUMMARY OF THE INVENTION

The subject invention takes advantage of the fact that a turbine engine is effectively a pressure vessel in which the pressure and temperature varies as a function of engine operating conditions. These variations of pressure and temperature within the engine cause small but predictable movements of parts of the engine relative to one another. For example, the gas producing nozzle located in advance of the rotating turbine assembly is attached to the diffuser housing. The turbine shroud, on the other hand, is attached to the rear bearing support housing. The turbine shroud typically will be substantially adjacent to some portion of the nozzle. However, the shroud and the nozzle are not fixedly attached to one another so that the engine can be disassembled easily for maintenance. Seal rings generally are disposed intermediate the shroud and the nozzle to ensure a proper flow of gas through the rotating turbine assembly rather than around the perimeter of the shroud. Because the shroud and the nozzle are attached to different parts of the engine, there is likely to be relative movement therebetween as conditions in the engine change. Although this relative movement between the nozzle and the shroud is quite small, it is predictable.

In the prior art engine, the sealing rings between the nozzle and the shroud are spaced from the inlets and outlets for the cooling air channels in the shroud, so that the flow of cooling air is assured of being maintained. It has been discovered, however, that the cooling air inlets of the shroud can be located and configured with respect to other parts of the engine, such that these cooling air inlets are at least partly blocked during certain operating conditions to minimize the flow of cooling air into the shroud. More particularly, the inherent and predictable expansion and contraction of the engine caused by variations in pressure and temperature can be relied upon to modulate the flow of cooling air into the shroud such that the shroud will contract more slowly in response to the engine heat reduction which accompanies certain operating conditions. Thus, as explained above, the slower contraction of the shroud will enable a smaller tip clearance under a broader range of operating conditions. It must be emphasized that this modulation of the cooling air flow into the shroud can be carried out passively in accordance with the subject invention. This is a substantial advantage over the complex prior art devices to control shroud expansion and contraction. Furthermore the passive modulation enabled by the subject invention is inherent in the operation of the engine and therefore is more reliable.

In the preferred embodiment, as explained further below, the cooling air inlets in the shroud are disposed substantially adjacent to the sealing rings between the shroud and the nozzle. More particularly, the location and shape of the cooling air inlets in the shroud are such that under certain operating conditions the sealing rings between the shroud and the nozzle will block the cooling air inlets. However, under operating conditions where shroud cooling is desired, the higher pressures within the engine during those conditions will move the nozzle and the shroud relative to one another such that the sealing rings do not cover the cooling air inlets in the shroud. As explained in greater detail below, the relative positions of the rings with respect to the cooling air entrances in the shroud can be calibrated by machining at least portions of the inner surfaces of the rings. Furthermore a blocking means other than a sealing ring can be employed to block the cooling air inlets in the shroud provided there is relative movement between the blocking means and the shroud under various conditions of pressure and temperature as explained herein.

DETAILED DESCRIPTION OF THE PREFERRED EMBODIMENT

Figure 1:
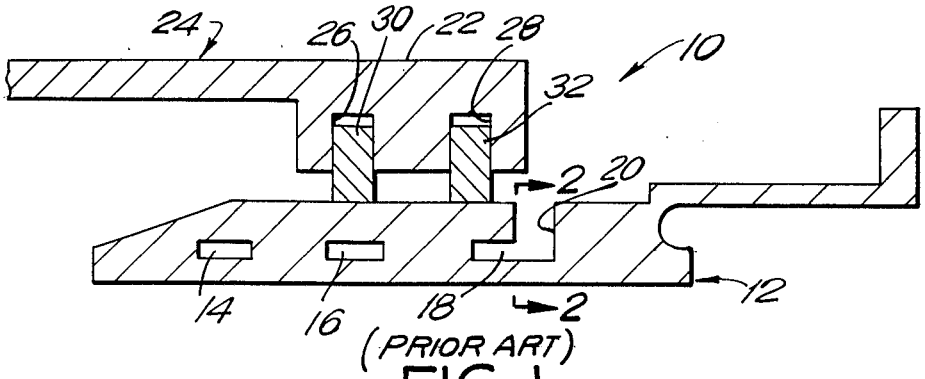
(PRIOR ART) FIG. 1
FIG. 1 is a cross-sectional view of a portion of a prior art turbine engine including the shroud.
Figure 2:
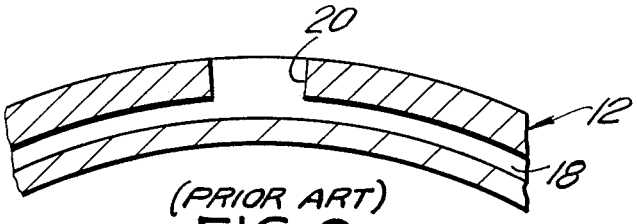
(PRIOR ART) FIG. 2
FIG. 2 is a cross-sectional view taken along line 2—2 in FIG. 1.

FIG. 1 shows a portion of a prior art turbine engine which is indicated generally by the numeral 10. The engine 10 includes a shroud 12, which as illustrated more clearly in FIG. 2 is of generally cylindrical construction. The shroud 12 is a stationary member which is disposed substantially concentrically around the rotating turbine assembly (not shown). As noted above, the shroud 12 is fixedly attached to the rear bearing support housing of the engine.

The shroud 12 includes a plurality of generally circumferential cooling passages 14, 16 and 18. Cooling passage 18 includes inlet 20. The cooling air inlet 20 is in communication with combustor (not shown) of engine 10. Although only one inlet 20 is illustrated in FIGS. 3–6, a plurality of such inlets will be disposed periodically around the circumference of shroud 12. Additionally, although not shown, the cooling passages 14, 16 and 18 will be in communication with one another and with an outlet. During operation of engine 10, cooling air from the combustor will be directed into passages 14, 16 and 18 through inlet 20 to control the heat expansion of shroud 12.

Disposed adjacent to and concentrically surrounding the shroud 12 is a flange 22 of nozzle assembly 24. The nozzle 24 is a stationary structure attached to the diffuser (not shown) which, in turn, is attached to the diffuser housing (not shown). The flange 22 of nozzle 24 includes a plurality of circumferential grooves 26 and 28 disposed on the inwardly facing surface thereof. Sealing rings 30 and 32 are mounted in the grooves 26 and 28 respectively of the nozzle 24. The sealing rings 30 and 32 extend radially inwardly to the shroud 12 to prevent the flow of gas between shroud 12 and nozzle 24. In the prior art engine 10, the sealing rings 30 and 32 are axially spaced from the cooling air inlet 20 to cause a substantially continuous flow of cooling air into inlet 20 and passages 14, 16 and 18.

As noted briefly above, turbine engines in general are essentially pressure vessels wherein various parts move relative to one another in response to pressure conditions therein. Furthermore, a movement of parts relative to one another also is caused by changes in temperature in response to different engine operating conditions. The prior art engine was constructed to ensure a flow of cooling air into the shroud regardless of dimensional changes in the engine. Thus cooling air flow and dimensional changes caused by pressure and temperature were independent of one another in the prior art engine.

Figure 4:
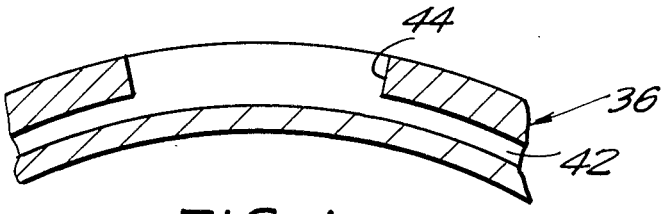
FIG. 4 is a cross-sectional view taken along line 4—4 in FIG. 3.
Figure 3:
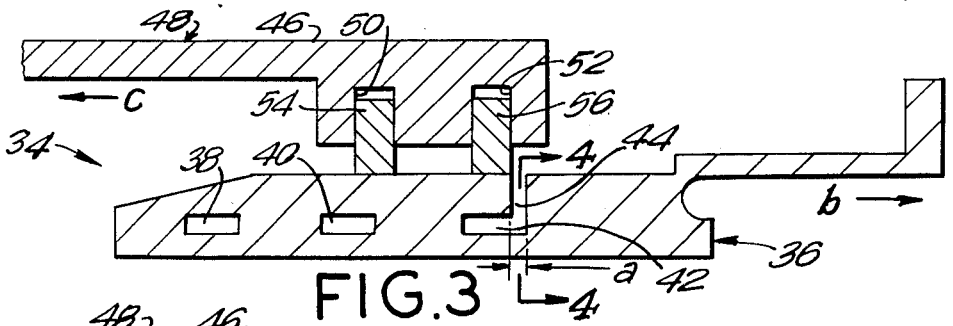
FIG. 3 is a cross-sectional view of a portion of turbine engine according to the subject invention showing the shroud thereof.

Turning to FIGS. 3 and 4, the engine of the subject invention is indicated generally by the numeral 34. As indicated above, the engine 34 includes a generally cylindrical shroud 36 which is fixedly mounted to the rear bearing support housing (not shown). The shroud 36 concentrically surrounds the rotating turbine assembly (not shown). Shroud 36 includes a plurality of cooling air passageways 38, 40 and 42 which are in communication with one another. In the manner described above, cooling passage 42 is in communication with the combustor of engine 34 through cooling air inlet 44.

The flange 46 of nozzle 48 is disposed concentrically around the shroud 36. Flange 46 includes inwardly directed circumferential grooves 50 and 52 in which circumferential sealing rings 54 and 56 respectively are mounted. The sealing rings 54 and 56 extend to the shroud 36 to prevent the flow of gases between shroud 36 and nozzle 48.

As illustrated in FIGS. 1 through 4, the area of each cooling air inlet 44 on the shroud 36 of the subject invention is substantially equal to the area of inlet 20 on prior art shroud 12. These equal areas reflect the need for substantially equal flows of cooling air during high power conditions. However the cooling air inlet 44 on the shroud 36 of the subject invention is smaller in an axial direction and wider in a circumferential direction than the cooling air inlet 20 on the prior art shroud 12 illustrated in FIGS. 1 and 2. More particularly, the axial dimension of the cooling air inlet 44 as illustrated by the dimension "a" in FIG. 3 is of a size that is less than the relative movement of the shroud 36 and nozzle 48 as a result of pressure and temperature variations within engine 34. Furthermore, the location of cooling air inlet 44 and sealing ring 56 relative to one another in such that during certain conditions of pressure and temperature within engine 34 the sealing rings 56 will move over and temporarily completely block the cooling air inlet 44. The resulting passive modulation of cooling air entering the passages 38, 40 and 44 is described in the following paragraphs.

FIG. 3 illustrates the spatial relationship between the shroud 36 and nozzle 48 at a high power operating condition. More particularly, as noted above, the turbine engine 34 is effectively a pressure vessel, with the shroud 36 and the nozzle 48 being mounted at distances substantially spaced from one another within the engine 34. During high power operating conditions the pressures within engine 34 are great. As a result the shroud 36 will tend to move slightly in direction "b" relative to nozzle 48, while nozzle 48 will tend to move slightly in direction "c" relative to the shroud 36. The high power operating condition which causes this relative axial movement of shroud 36 and nozzle 48 also yields temperature levels which require substantial cooling of shroud 36. As illustrated clearly in FIG. 3, this opposite axial movement of shroud 36 and nozzle 48 relative to one another will result in the substantially complete opening of cooling air inlet 44. Stated differently, the cooling air inlet 44 and the sealing ring 56 are located such that under high power operating conditions the cooling air inlet 44 will be substantially unimpeded by the sealing ring 56.

When the power is reduced to flight idle, the internal pressures within engine 34 drop approximately 75%. This reduction in pressure causes a relative axial movement of shroud 36 and nozzle 48 toward one another as indicated by arrows "d" and "e" respectively. This pressure drop occurs quite quickly, and the resultant relative movements between the shroud 36 and nozzle 48 will be sufficient for the ring 56 to completely block the cooling air inlet 44. Stated differently, the axial dimension "a" of the cooling air inlet 44 is such that the maximum movement of the shroud 36 and nozzle 48 relative to one another will be sufficient to cause the sealing ring 56 to completely cover the cooling air inlet 44. Blockage of cooling air into the shroud 36 will substantially reduce the rapid cooling of the shroud 36. More particularly, with the cooling air flow into the shroud 36 blocked, the rates of contraction of the shroud 36 and the turbine assembly will be more nearly equal to one another, and blade tip rubbing will be unlikely even when the cold tip clearance is small.

The gradual cooling of the turbine engine 34 resulting from the lower temperature and pressure conditions in the combustor will gradually cause a thermal contraction of the various parts of the engine. More particularly as the shroud and nozzle slowly cool down they will grow smaller. The dimensional changes resulting from this thermal contraction occur more slowly than the dimensional changes resulting from variations in pressure. The relatively slow thermal contraction will cause the shroud to recede toward its mounting on the rear bearing support housing as indicated by arrow "f". Similarly the nozzle will contract toward its mounting on the diffuser and diffuser housing, as indicated by arrow "g". This movement of the shroud 36 and the nozzle 48 away from one another will cause at least a partial opening of the cooling air inlet 44 thus enabling some cooling air to flow into the shroud 36. By properly dimensioning the cooling air inlet 44, and by properly positioning the shroud 36 and nozzle 48 with respect to one another, the cooling air inlet 44 can be partly blocked during the low pressure and low temperature conditions shown in FIG. 5 thereby enabling a flow of cooling air into the shroud 36 and that is consistent with the cooling needs under these operating conditions.

Figure 5:
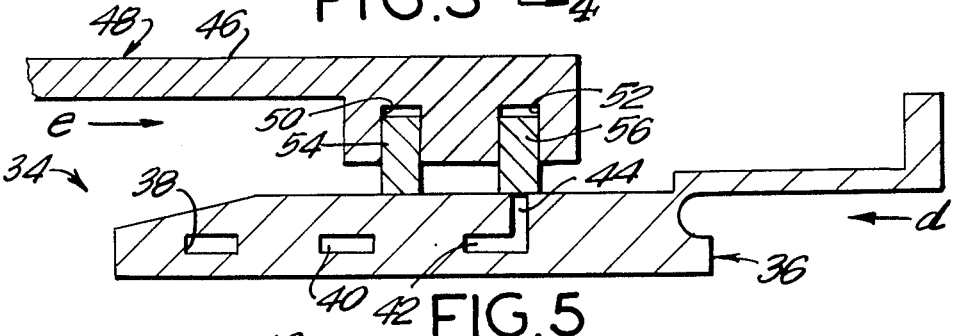
FIG. 5 is a cross-sectional view similar to that shown in FIG. 3 but under different engine operating conditions.
Figure 6:
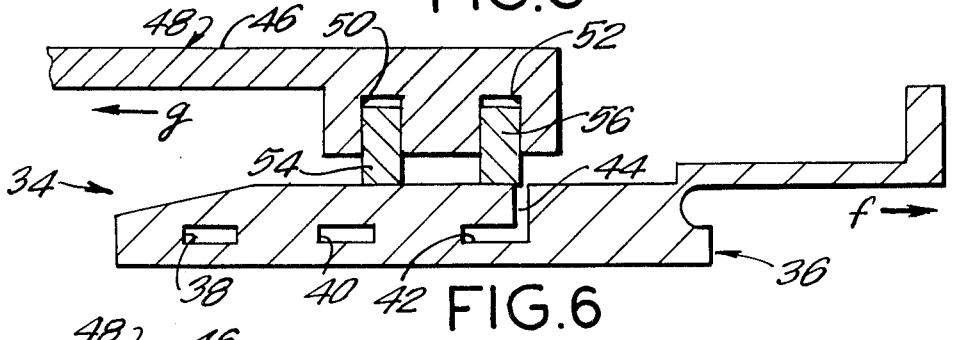
FIG. 6 is a cross-sectional view similar to that of FIGS. 3 and 5, but under a still different engine operating condition.

As an example, it has been found that in a typical turbine engine the pressures normally encountered in the engine will cause a movement of the shroud 36 and nozzle 48 relative to one another of approximately 0.035". The temperature distribution in the same engine will cause a relative movement between these same parts of 0.045". The aft sealing ring 56 is positioned with respect to the cooling air inlet 44 in the shroud 36 such that at high power conditions, the cooling air inlets 44 are exposed axially 0.015" as indicated by dimension "a" in FIG. 3. When the power is reduced to flight idle, the internal pressures of the engine 34 will drop approximately 75%. This causes the aft ring 56 to move in the direction "e" as shown in FIG. 5, approximately 0.026" (0.035"×0.75=0.026"). This movement will occur quite rapidly and will result in a complete blockage of the cooling air inlet 44. More particularly the cooling air inlet 44 will be covered by approximately 0.011" (0.026"−0.015"=0.011").

At the flight idle condition, the temperatures of the engine drop about 40% of their level during high power conditions. This cooling, which occurs over time will cause the shroud 36 and nozzle 48 to move in the directions indicated by arrows "f" and "g" as shown in FIG. 5. The magnitude of this movement will be approximately 0.018" (0.40×0.045"=0.018"). As a result of this movement the cooling air inlet 44 will have an axial opening of approximately 0.007" (0.018"−0.011"=0.007"). This smaller axial opening of the cooling air inlet 44 will provide for a sufficient flow of cooling air during these lower power conditions.

It must be emphasized that the dimensional changes resulting from pressure variations occur much more quickly than the dimensional changes resulting from temperature variations. As a result, after a cutback from a high power operating condition to flight idle (going from the FIG. 3 to the FIG. 5 condition) the cooling air inlets 44 will remain completely blocked for a period of time. The length of time during which the cooling air inlets 44 are completely blocked will be a function of the dimensions selected for the various components. However in the typical installation, the aft ring 56 will block the cooling air inlet 44 for at least the ten to twenty second period during which a rub of the turbine blades against the shroud 36 is possible.

It also should be emphasized that the structure described herein will provide for a lower flow of cooling air during the low power conditions when cooling air is not particularly required. Consequently this air on which work has been performed will not be withdrawn from the compressor, thereby yielding improved engine efficiency.

Figure 7:
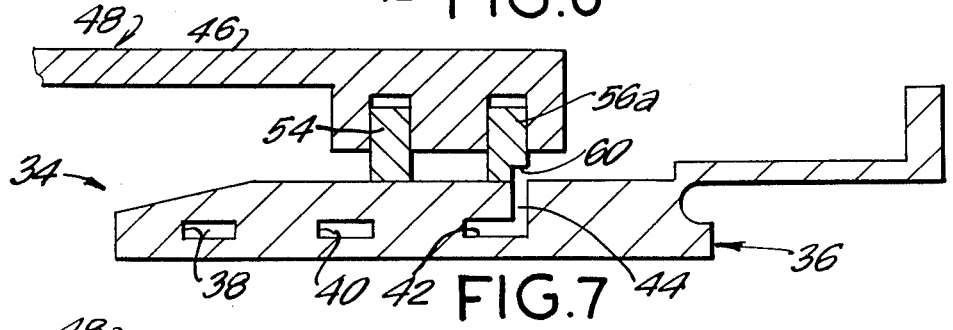
FIG. 7 is a cross-sectional view of a portion of an alternate embodiment of an engine according to the subject invention and showing the shroud thereof.
Figure 8:
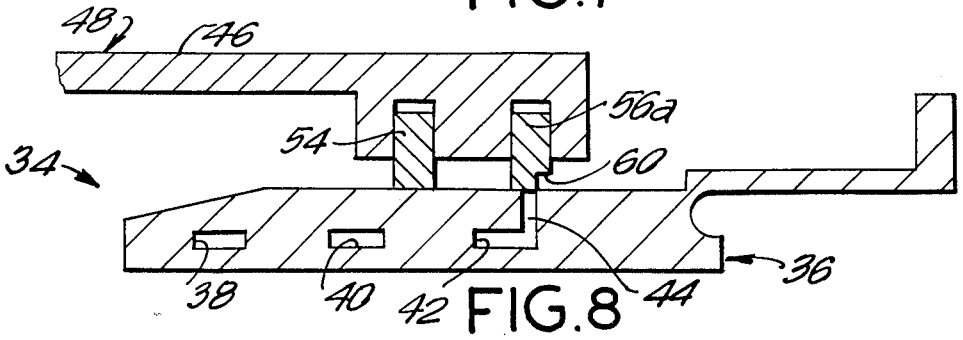
FIG. 8 is a cross-sectional view similar to FIG. 7 but under different engine operating conditions.

As described above, the invention relies to a significant extent on the relative locations of the aft ring 56 and the cooling air inlets 44. The precise modulation characteristics for the flow of cooling air into the shroud 36 can be calibrated by providng a relief in a portion of the aft ring 56. As shown in FIGS. 7 and 8, this relief can be provided by forming a rabbet groove 60 as shown in the aft ring 56*a*. The dimension of the rabbet groove 60 is selected to ensure a functional operation substantially identical to that described with reference to FIGS. 3 through 6 above. Although FIGS. 7 and 8 show a generally right angle rabbet groove 60, a chamfer or other similar dimensional relief would be equally acceptable.

In summary a turbine engine is provided to passively modulate the flow of cooling air into the turbine shroud. More particularly, the sealing ring between the cooling shroud and the nozzle is disposed to modulate the flow of cooling air into the shroud. The modulation is caused by dimensional changes within the engine resulting from variations of pressure and temperature. Thus, during the period immediately following a reduction from high power to low power operating conditions the flow of cooling air into the turbine shroud will be completely blocked. After a period of time, however, the cooling air inlets to the turbine shroud will be partially cleared enabling a flow of cooling air into the shroud which is substantially equal to the cooling requirements under these operating conditions. Upon the onset of a high power operating condition the pressure changes will cause a complete opening of the cooling air inlet thereby modulating the heat expansion of the turbine shroud.

While the preferred embodiment of the subject invention has been described and illustrated, it is obvious that various modifications can be made therein without departing from the spirit of the present invention which should be limited only by the scope of the appended claims.

What is claimed is:

1. A turbine engine having a rotatable turbine assembly, a generally cylindrical shroud disposed concentrically around at least a portion of said turbine assembly and a sealing ring disposed generally concentrically around said shroud, said shroud being provided with at least one cooling air passage extending therethrough and at least one cooling air inlet extending into said at least one cooling air passage, said sealing ring and said shroud being axially movable with respect to each other, said at least one cooling air inlet being dimensioned and positioned with respect to said sealing ring such that under at least certain operating conditions of said engine said sealing ring moves relative to said shroud to block said at least one cooling air inlet.

2. A turbine engine as in claim 1 wherein said engine undergoes dimensional changes as a result of pressure and temperature changes therein, and wherein said sealing ring and said shroud are mounted to parts of said engine spaced from each other, said that dimensional changes of said engine due to pressure changes therein cause the relative movement between said shroud and said sealing ring.

3. A turbine engine comprising a rotatable turbine assembly and a generally cylindrical shroud disposed concentrically around at least a portion of said turbine assembly, said shroud including an array of cooling air passages extending generally circumferentially therethrough and at least one cooling air inlet extending generally radially inwardly into said array, said turbine engine further including blocking means disposed adjacent said shroud and movable relative thereto in a direction generally parallel to the axis of said generally cylindrical shroud, said movement of said blocking means relative to said shroud being caused by dimensional changes of said engine resulting from pressure and temperature changes therein, and said movement positioning said blocking means to at least partly block said at least one cooling air inlet during at least certain operating conditions of said turbine engine and to completely block said at least one cooling air inlet during at least certain other operating conditions of said engine.

4. A turbine engine as in claim 3 wherein said at least one cooling air inlet is characterized by an axial dimension which is less than the relative pressure and temperature related movements of said blocking means relative to said shroud.

5. A turbine engine comprising a rotatable turbine assembly, a nozzle and a generally cylindrical shroud disposed concentrically around at least a portion of said turbine assembly, said shroud including an array of cooling air passages extending generally circumferentially therethrough and at least one cooling air inlet extending generally radially inwardly into said array, said turbine engine further including blocking means comprising a sealing ring fixedly mounted to said nozzle and concentrically surrounding said shroud and movable relative thereto, said blocking means being positioned with respect to said at least one cooling air inlet such that under high pressure and temperature operating conditions of said engine, said blocking means enables cooling air to be directed into said cooling air passages through said at least one cooling air inlet and during operating conditions substantially immediately following a deceleration of the engine, said blocking means is disposed with respect to said at least one cooling air inlet such that said at least one cooling air inlet is completely blocked, and further, said sealing ring blocking means being dimensionally relieved adjacent said at least one cooling air inlet, whereby the dimensional relief enables proper blocking of said at least one cooling air inlet by said sealing ring blocking means under various operating conditions of the engine.

6. A turbine engine as in claim 5 wherein the dimensional relief comprises a rabbet groove extending substantially circumferentially around said sealing ring.

* * * * *